US007182655B2

(12) United States Patent
Chen et al.

(10) Patent No.: US 7,182,655 B2
(45) Date of Patent: Feb. 27, 2007

(54) METHOD AND DEVICE FOR WIRING CONNECTION

(75) Inventors: Dwo Chen, Taipei (TW); Tsung-Kuo Yang, Taipei (TW); Zhao-An Jiang, Taipei (TW); Charles Chou, Taipei (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/812,130

(22) Filed: Mar. 29, 2004

(65) Prior Publication Data

US 2004/0209528 A1 Oct. 21, 2004

(30) Foreign Application Priority Data

Apr. 18, 2003 (TW) ..... 92109155 A

(51) Int. Cl.
*H01R 4/10* (2006.01)

(52) U.S. Cl. ..... 439/877; 439/83; 174/261; 29/854

(58) Field of Classification Search ..... 439/877, 439/83; 174/261; 29/854
See application file for complete search history.

(56) References Cited

U.S. PATENT DOCUMENTS 2,856,593 A * 10/1958 Gookin ..... 439/741
4,420,877 A * 12/1983 McKenzie, Jr. ..... 29/739
4,723,925 A * 2/1988 Orr et al. ..... 439/877
6,551,150 B2 * 4/2003 Machado ..... 439/876

* cited by examiner

*Primary Examiner*—Truc Nguyen
(74) *Attorney, Agent, or Firm*—Volpe & Koening, P.C.

(57) ABSTRACT

A method and device for wiring connection is provided. The method for wiring connection includes steps of applying at least a barrel pin to a printed circuit board, riveting one end of the barrel pin to the printed circuit board, soldering the barrel pin on the printed circuit board, inserting at least a wiring into the barrel pin via the other end of the barrel pin, and fixing the wiring inside the barrel pin.

20 Claims, 5 Drawing Sheets

METHOD AND DEVICE FOR WIRING CONNECTION

FIELD OF THE INVENTION

This invention relates to a method and device for wiring connection, and more particularly to a method and device for connecting the wiring applied to an electronic ballast.

BACKGROUND OF THE INVENTION

Please refer to FIG. 1, which illustrates a printed circuit board completed by a conventional operating procedure for wiring connection. Just as one skilled in the art can be recognized, the conventional wiring connection operating procedure for a printed circuit board generally can be separated into two types.

The first kind of operating procedure always comprises the following steps. Firstly, a wiring 101 is inserted to be mounted at a printed circuit board 100; and secondly, the printed circuit board 100 and the wiring 101 are together passed through an air reflow oven. However, through this operating procedure, some disadvantages are exposed: (1) if the wiring is mounted on the printed circuit board in advance, the oven passed by the printed circuit board must be enlarged because the volume of the printed circuit board is increased by the additionally inserted wiring so that the time for passing the oven will be increased; (2) the wiring and the printed circuit board are passed through the oven together, and thus, the surface of the wiring might be influenced by the heat provided by the oven or being contacted with the oven so as to be, for example, shrank, bubbled etc.; (3) a tool for passing through the oven should be specially made which will therefore increase the cost; (4) because electronic elements must be mounted on the printed circuit board prior to the wiring connection, the assembling time will be increased owing to the large number of wiring; and (5) after being soldered, the printed circuit board with the wiring is sequentially packaged in a case so that the soldered joint has a great opportunity to be pulled, and thus the solder might be departed or rent from the printed circuit board.

As to the second wiring connection operating procedure, it always comprises steps of: (1) mounting electronic elements 102 on a printed circuit board 100; (2) passing the printed circuit board with the electronic elements through an air reflow oven for soldering the electronics elements 102 on the printed circuit 100; and (3) connecting the wiring to the printed circuit board and soldering the wiring from the reverse surface of the printed circuit board one by one through manpower. However, through this operating procedure, some disadvantages are still exposed: (1) the wiring connection is completed by manpower so that the processing time must be increased; (2) the solder quality is hard to be kept at a constant level because the manual operation; (3) because the core of the wiring is solid and the solder is completed by manpower, the wiring might have a poor wetting ability when a supplement therefor is lacked; and (4) after being soldered, the printed circuit board with the wiring is sequentially packaged in a case so that the soldered joint has a great opportunity to be pulled, and thus the solder might be departed or rent from the printed circuit board.

Consequently, because of the technical defects described above, the applicant keeps on carving unflaggingly to develop a "method and device for wiring connection" through wholehearted experience and research.

SUMMARY OF THE INVENTION

In accordance with one aspect of the present invention, a method for wiring connection includes steps of applying at least a barrel pin to a printed circuit board, riveting one end of the barrel pin to the printed circuit board, soldering the barrel pin on the printed circuit board, inserting at least a wiring into the barrel pin via the other end of the barrel pin, and fixing the wiring inside the barrel pin.

Meanwhile, the barrel pin and the printed circuit board are electrically soldered together through passing through an air reflow oven.

Preferably, the method further includes a step of mounting at least an electronic element on the printed circuit board so as to be passed through an air reflow oven simultaneously with the printed circuit board and the barrel pin.

Preferably, the wiring connection is a process for an electronic ballast

Accordingly, the barrel pin is nickel-plated so that a wetting ability thereof becomes relatively worse.

Furthermore, the riveting step is performed by a first tool, the fixing step is performed by a second tool and the second tool is a taper tool for hitting the barrel pin to form a taper recess so as to fasten the wiring thereinside.

In accordance with another aspect of the present invention, a wiring connection device for a printed circuit board includes at least a barrel pin mounted at the printed circuit board being riveted and soldered thereon for an electrical connection between the printed circuit board and the barrel pin and hit for fastening at least a wiring thereinside and for an electrical connection between the barrel pin and the wiring.

Preferably, the barrel pin is riveted by a first tool and the barrel pin is hit by a second tool, and furthermore, the second tool is a taper tool for hitting the barrel pin to form a taper recess so as to fasten the wiring therein side.

Accordingly, the barrel pin and the printed circuit board are electrically soldered together through passing through an air reflow oven and the wiring connection device is used for an electronic ballast.

In accordance with further another aspect of the present invention, a wiring connection device for a printed circuit board includes at least two barrel pins mounted at a side of the printed circuit board being riveted and soldered thereon for an electrical connection between the barrel pins and the printed circuit board and hit for fastening at least a wiring thereinside and for an electrical connection between the barrel pins and the wiring.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The object of the present invention is to provide a method for wiring connection which can be completed through an automatic machine for avoiding the defects caused by manual operation so as to maintain the quality.

Another object of the present invention is to provide a novel method and device for wiring connection and thereby the wiring does not need to be passed through an air reflow oven so that it can avoid the wiring from being damaged and also reduce the operation time.

Figure 1:
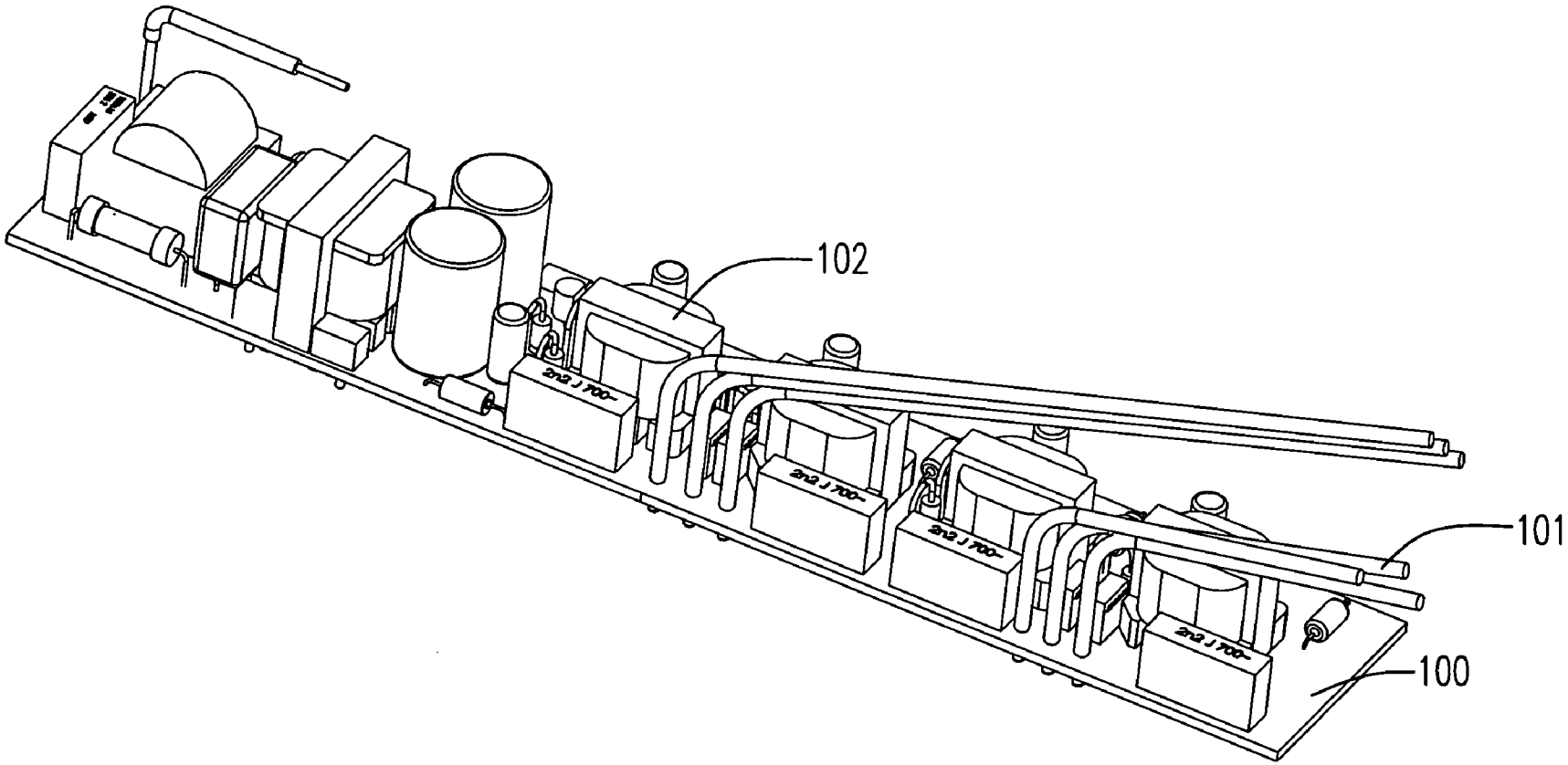
Fig. 1 (PRIOR ART)
FIG. 1 is a structurally schematic view showing a printed circuit board assembled by a conventional wiring connection method.
Figure 2A:
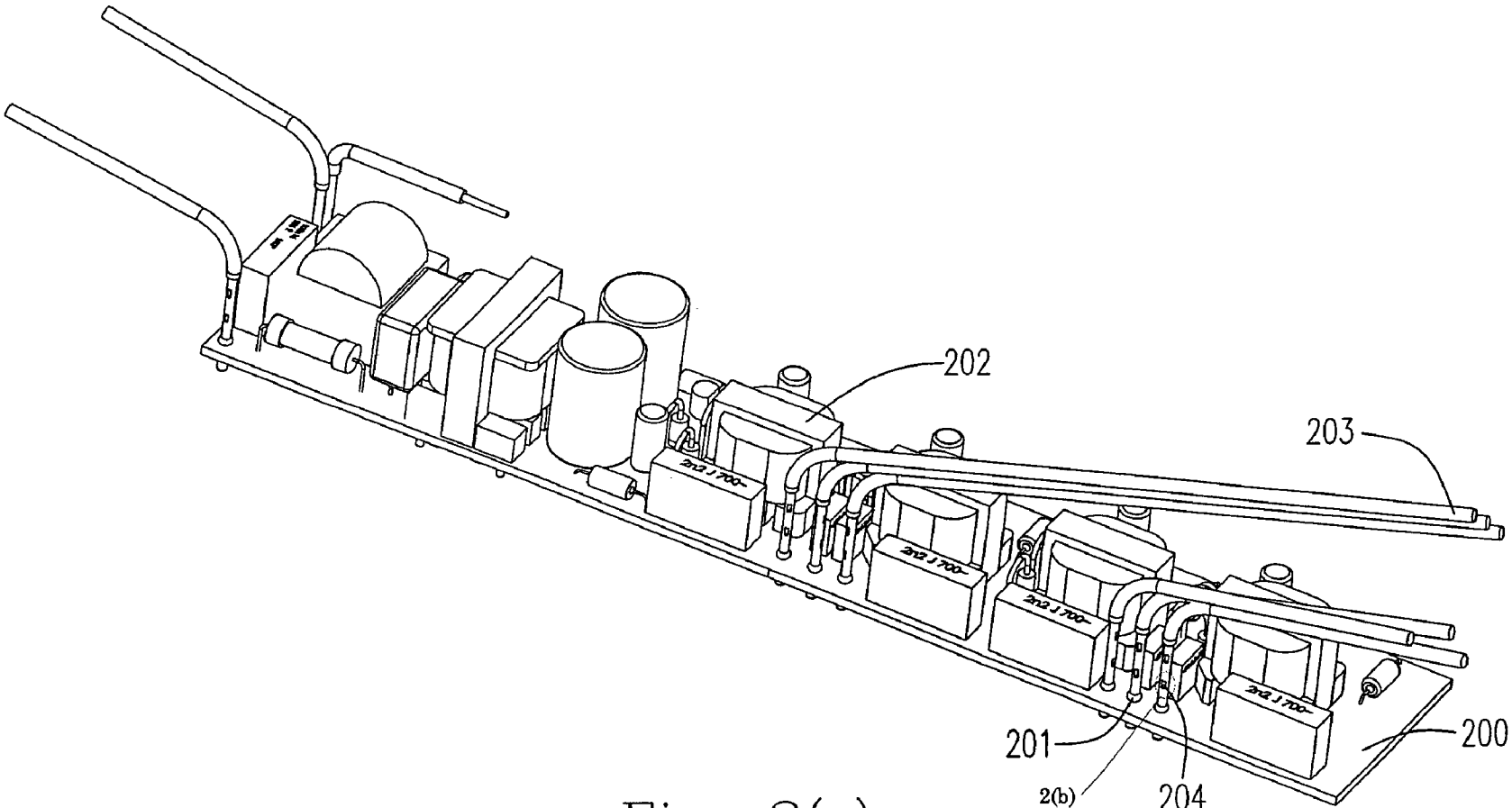
FIGS. 2(*a*)–2(*b*) are structurally schematic views showing a printed circuit board with the wiring assembled by a wiring connection method and device in a first preferred embodiment according to the present invention and a cross-sectional view of the taper recess of FIG. 2(*a*) respectively.
Figure 2B:
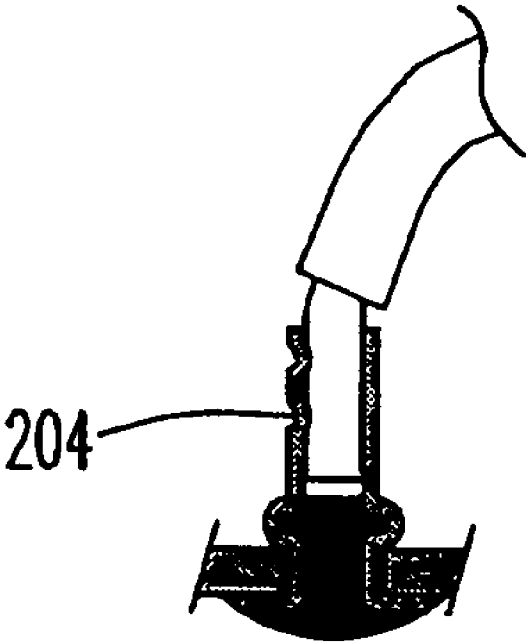

Now, please refer to FIG. 2(*a*), which illustrates a structurally schematic view showing a method and device for wiring connection according to the present invention. As shown in FIG. 2(*a*), the wiring connection device according to the present invention employs a barrel pin 201. The barrel pin 201 is firstly applied to a printed circuit board 200 through one end thereof which is then riveted by a first tool (not shown) so as to be fixed on the printed circuit board 200. Sequentially, the barrel pin 201 is soldered for being electrically connected to the printed circuit board 200 and then the electronic element 202 is also mounted on the printed circuit board 200 so that the electronic element 202, the barrel pin 201 and the printed circuit board 200 can be passed through an air reflow oven simultaneously for soldering. Then, the wiring 203 is inserted into the barrel pin 201 via the other end thereof and then through a second tool (not shown), the wiring 203 can be fixed and fastened inside and electrically connected to the barrel pin 201.

Because the barrel pin 201 is nickel-plated in advance, a wetting ability thereof is poor and the whole barrel pin will not be filled with solder owing to the capillarity during passing through the air reflow oven. Therefore, the space for holding the wiring can stay clear. At this time, because the riveted and soldered end of the barrel pin 201 on the printed circuit board is completed sealed, the wiring 203 will not be penetrated through the barrel pin 201 and also the printed circuit board 200 when sequentially being inserted into the barrel pin 201. Moreover, after the barrel pin 201 is riveted and soldered on the printed circuit board and the wiring 203 is fixed and fastened inside the barrel pin 201, the solder on the printed circuit board 200 will not be rent because of a pulling or twisting force applying on the wiring 203.

Furthermore, the second tool for fixing and fastening the wiring 203 inside the barrel pin 201 can be a taper tool. The taper tool will hit the barrel pin 201 to inwardly form two taper recesses 204 (see FIG. 2(*b*)), and the two taper recesses 204 can therefore urge against the wiring inside the barrel pin 201 so that the wiring 203 can come through the pulling or twisting force and a rent solder on the printed circuit board which might happen in the prior art. Alternatively, the barrel pin 201 can be hit inwardly by the taper tool to form two pairs of opposite taper recesses which also can fix and fasten the wiring inside the barrel pin.

The wiring connection method and device according to the present invention is advantageous that:

(1) All the processes of fixing the barrel pin through riveting and passing through the air reflow oven for soldering, inserting the wiring into the barrel pin and fixing and fastening the wiring inside the barrel pin can be proceeded automatically so that man power can be saved and operation time can also be reduced;

(2) Because the processes can be automatically completed without the manual operation, the quality can be kept at a stable level;

(3) Because the air reflow oven does not need to be enlarged owing to the wirings previously mounted on the printed circuit board as described in the prior art, the flow rate thereof can be increased and the throughput can be improved, too;

(4) The wiring does not pass through the oven, and thus, it will not be damaged to become, for example, shrank, bubbled etc.

(5) The design of the production line of the present invention can be more ordered than that of the conventional procedure, the management for the materials and supplies can be easier and the flow path of the production also can be controlled well; and (6) Although the cost will be slightly increased by using the barrel pin, the overall cost however can be reduced because of the saved assembling time and manpower.

Figure 3:
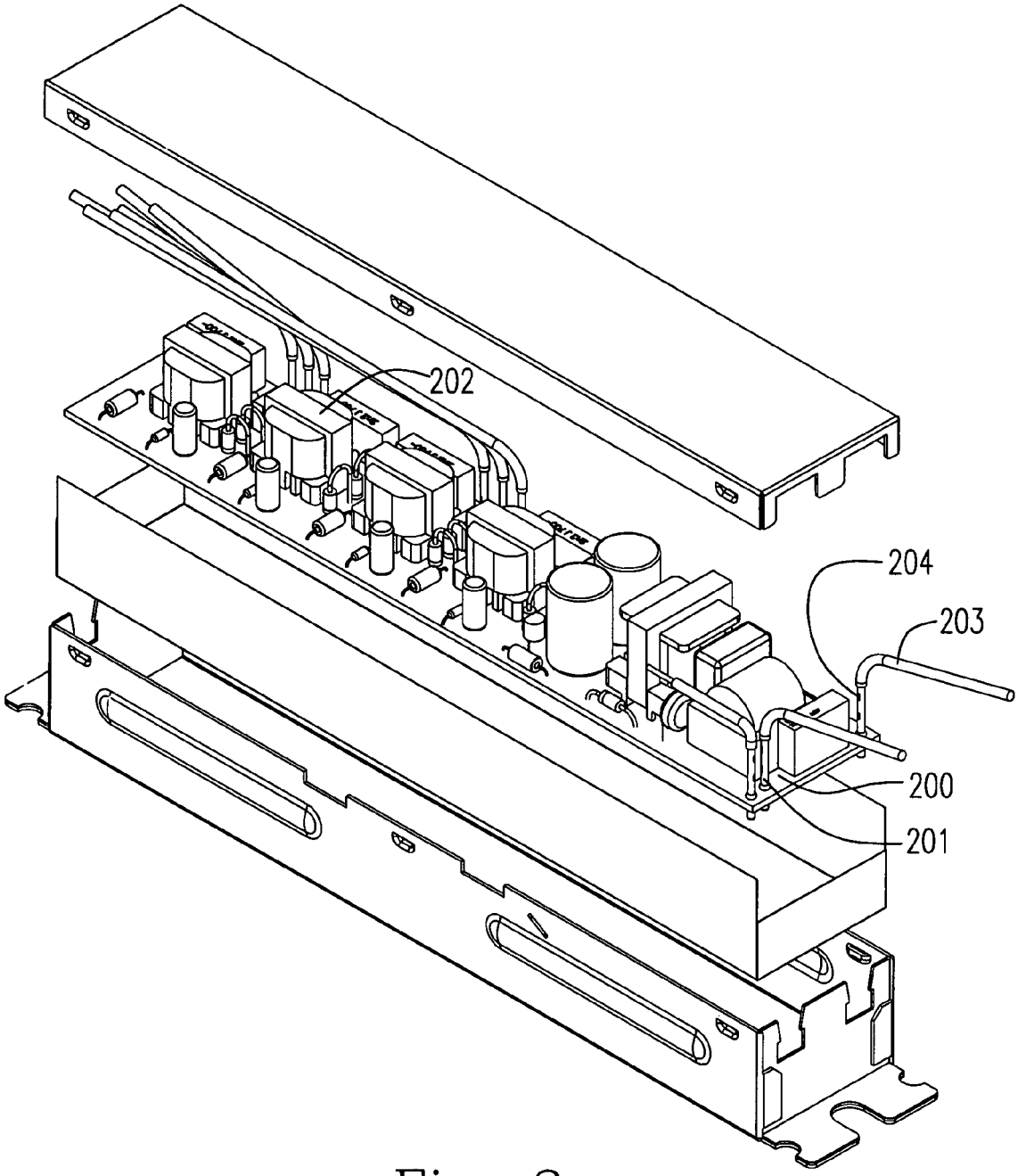
FIG. 3 is a structurally schematic view showing the application of the barrel pin and the wiring connection according to the present invention to an electronic ballast.

Preferably, the application of the wiring connection method and device according to the present invention is for an electronic ballast, as shown in FIG. 3.

Figure 4:
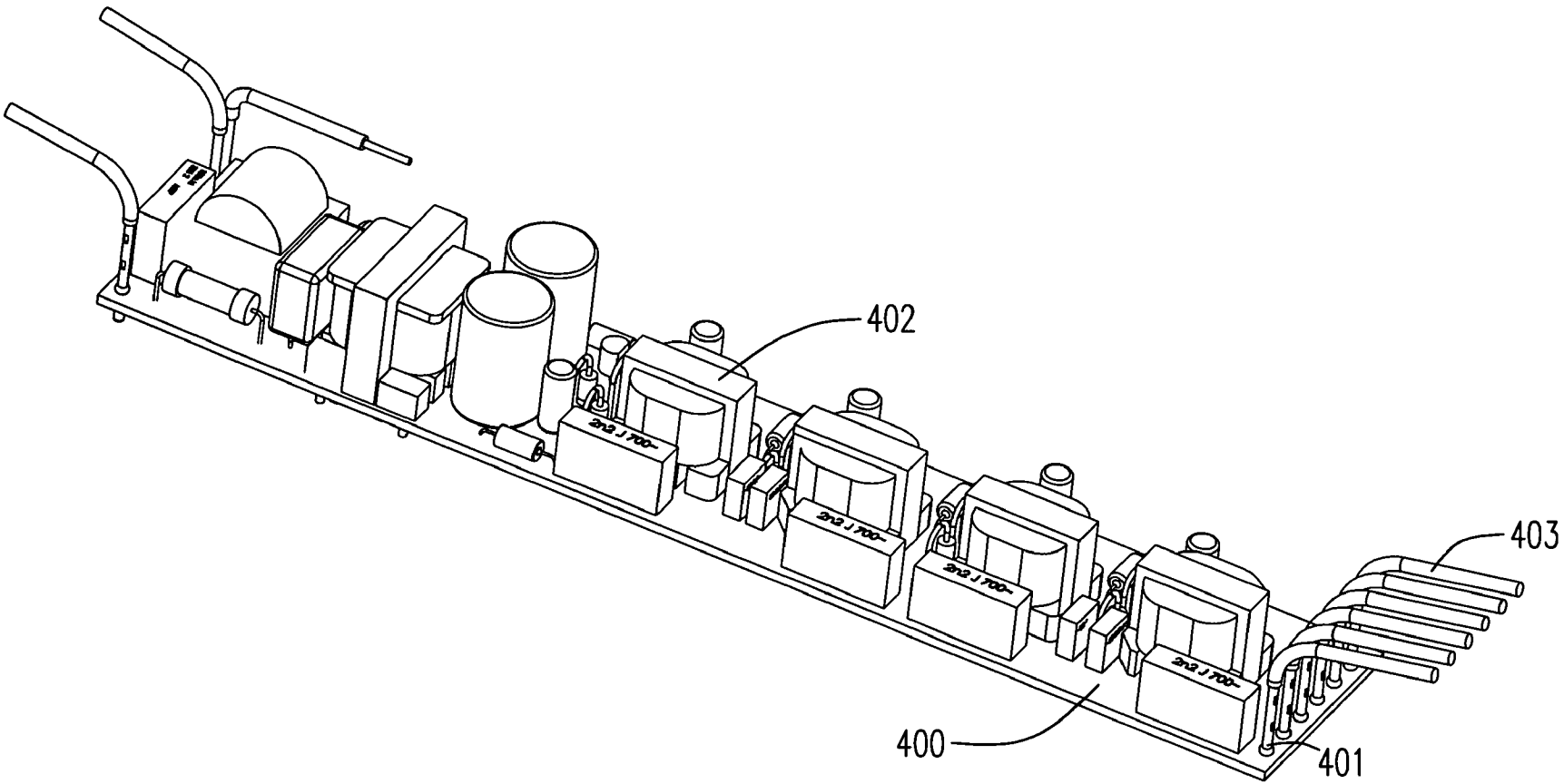
FIG. 4 is a structurally schematic view showing a printed circuit board with the wiring assembled by a wiring connection method and device in a second preferred embodiment according to the present invention

Additionally, the method and device for wiring connection according to the present invention also can be implemented in another manner, as shown in FIG. 4, which is a structurally schematic view showing the wiring connection method and device in a second preferred embodiment. In this embodiment, the barrel pins 401 are mounted at a same side of the printed circuit board 400, then the barrel pins 401, the electronic element 402 and the printed circuit board 400 are simultaneously soldered for electrical connection and the wirings 403 are fixed and fastened inside the barrel pins 401 through a tool for electrical connection. Therefore, through the processes described above, the operation time of wiring connection can be reduced, too.

In view of the aforesaid, the wiring connection method and device according to the present invention not only can save the manual operation and reduce the operation time but also can be automatically operated by machine so that the solder quality can be maintained at a stable level and the solder on the printed circuit board also can stay stable. Consequently, the present invention is really a novel and progressive creation and conforms to the demand of the industry.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for wiring connection, comprising:

applying at least a barrel pin to a printed circuit board;

riveting one end of said barrel pin to said printed circuit board whereby a second end is disposed above said printed circuit board;

mounting an electronic element on said printed circuit board;

soldering said barrel pin and said electronic element on said printed circuit board by passing said printed circuit board through an air reflow oven;

inserting at least a wiring into said barrel pin having been soldered on said printed circuit board via the second end of said barrel pin; and fixing said wiring inside said barrel pin and above said printed circuit board by crimping said barrel pin.

2. The method according to claim 1, wherein said wiring connection is a process for an electronic ballast.

3. The method according to claim 1, wherein said barrel pin is nickel-plated so that a wetting ability thereof becomes relatively worse.

4. The method according to claim 1, wherein said crimping step is performed by a first tool.

5. The method according to claim 1, wherein said fixing step is performed by a second tool.

6. The method according to claim 1 wherein the applying the barrel pin to the printed circuit board, the riveting the barrel pin to the printed circuit board, and the soldering the barrel pin into the printed circuit board are performed before inserting the wiring into the barrel pin and fixing the wiring inside the barrel pin by crimping.

7. The method according to claim 5, wherein said second tool is a taper tool for hitting said barrel pin to form a taper recess so as to crimp said wiring thereinside.

8. A wiring connection device for a printed circuit board having an electronic element mounted thereon, the wiring connection device comprising:

at least a barrel pin having a first end riveted to said printed circuit board and a second end disposed above said printed circuit board, wherein said first end of said barrel pin and the electronic element are soldered to said printed circuit board for establishing electrical connections respectively between the barrel pin and the printed circuit board and between the electronic element and the printed circuit board such that a wiring can be inserted via said second end of said barrel pin and fastened in said barrel pin and above the barrel pin's soldered electrical connection with said printed circuit board for an electrical connection between said barrel pin and said wiring.

9. The device according to claim 8, wherein said wiring connection device comprises part of an electronic ballast.

10. The device according to claim 8 further comprising a wiring inserted via said second end of said barrel pin and crimped in said barrel pin above the barrel pin's soldered electrical connection with said printed circuit board for an electrical connection between said barrel pin and said wiring.

11. A wiring connection device for a printed circuit board having an electronic element mounted thereon, the wiring connection device comprising:

at least two barrel pins mounted on said printed circuit board by each having a first end being directly riveted thereon such that a second end of each barrel pin is disposed above said printed circuit board, wherein said first ends of said barrel pins and the electronic element are soldered to said printed circuit board for establishing electrical connections respectively between each of the barrel pins and the printed circuit board and between the electronic element and the printed circuit board such that, with respect to each barrel pin, at least a wiring can be inserted via said second end of the respective barrel pin and crimped above the respective barrel pin's soldered electrical connection with said printed circuit board for an electrical connection between the respective barrel pins and said wiring.

12. The device according to claim 11 further comprising, with respect to each barrel pin, a wiring inserted via said second end of the respective barrel pins and crimped in the respective barrel pins above the respective barrel pins' soldered electrical connection with said printed circuit board for an electrical connection between the respective barrel pins and said wiring.

13. The device according to claim 11 wherein the barrel pins are mounted along an edge of the printed circuit board.

14. The device according to claim 11 where at least three barrel pins are mounted along an edge of the printed circuit board.

15. A method for wiring connection, comprising:

applying at least a barrel pin to a printed circuit board;

riveting one end of said barrel pin to said printed circuit board whereby a second end is disposed above said printed circuit board;

mounting an electronic element on said printed circuit board; and soldering said barrel pin and said electronic element on said printed circuit board to make electrical connections respectively between the barrel pin and the printed circuit board and between the electronic element and the printed circuit board such that a wire can be inserted via the second end of said barrel pin and fastened in said barrel pin above the barrel pin's soldered electrical connection with said printed circuit board for an electrical connection between said barrel pin and said wire.

16. The deviee method according to claim 15, wherein said barrel pin is riveted by a first tool.

17. The method according to claim 15, wherein said wiring is fastened by a second tool.

18. The method according to claim 15, wherein said barrel pin, said electronic element and said printed circuit board are electrically soldered together by passing through an air reflow oven.

19. The method according to claim 15 further comprising:

inserting a wire into said barrel pin via the second end of said barrel pin; and crimping said wire inside said barrel pin to make an electrical connection between said barrel pin and said wire.

20. The method according to claim 17, wherein said second tool is a taper tool for fitting said barrel pin into a taper recess so as to crimp said wiring thereinside.

* * * * *